US006971532B1

(12) United States Patent
Williams et al.

(10) Patent No.: US 6,971,532 B1
(45) Date of Patent: Dec. 6, 2005

(54) SYSTEM AND METHOD OF FASTENERLESS CONSTRUCTION OF A DECORATIVE ARTICLE

(76) Inventors: G. Thomas Williams, 2640 Highland Rd., Zanesville, OH (US) 43701; Charles T. Williams, 2592 Highland Rd., Zanesville, OH (US) 43701

( * ) Notice: Subject to any disclaimer, the term of this patent is extended or adjusted under 35 U.S.C. 154(b) by 73 days.

(21) Appl. No.: 10/291,314

(22) Filed: Nov. 8, 2002

(51) Int. Cl.[7] ..... B65D 6/08
(52) U.S. Cl. ..... 217/122; 217/124; 147/48
(58) Field of Search ..... 220/610, 611, 615, 220/617, 9.4; 217/122–125; 147/48

(56) References Cited

U.S. PATENT DOCUMENTS

| | | | | | |
|---|---|---|---|---|---|
| 33,106 | A | * | 8/1861 | Sherman | 217/122 |
| 42,923 | A | * | 5/1864 | Beecher | 217/122 |
| 133,892 | A | * | 12/1872 | Russell | 217/123 |
| 209,168 | A | * | 10/1878 | Hatfield | 217/122 |
| 282,516 | A | * | 8/1883 | Hallock | 217/123 |
| 2,131,425 | A | * | 9/1938 | Cipar | 217/122 |
| 2,461,132 | A | * | 2/1949 | Bertis et al. | 220/610 |
| 4,188,983 | A | * | 2/1980 | Graham et al. | 139/424 |
| 5,339,584 | A | * | 8/1994 | Ohtake et al. | 52/208 |
| 5,816,437 | A | * | 10/1998 | Lin | 220/611 |
| 6,213,328 | B1 | * | 4/2001 | Tiramani et al. | 220/4.28 |
| 6,250,351 | B1 | * | 6/2001 | Langston et al. | 147/48 |

OTHER PUBLICATIONS

McGuire, John, Basketry: the Nantucket Tradition, pp. 8-9, 53-56, 60, 73-74, 112-116, Lark Books, New York, N.Y. (1990).

Unknown, Author, Appalachian White Oak Basketmaking, pp. 165-167, Publisher Unknown (Publication Year Unknown).

* cited by examiner

*Primary Examiner*—Joseph C. Merek
(74) *Attorney, Agent, or Firm*—Standley Law Group, LLP

(57) ABSTRACT

A system and method of constructing a substantially decorative article without the need for fasteners. In one exemplary embodiment of the invention, the decorative article is a woven basket. One or more retainers are provided to retain the material used to construct the outer surface of the decorative article. Each retainer is provided with a channel for receiving one end of the material used to construct the surface of the decorative article. The channels are able to retain the ends of the material used to construct the surface of the decorative article without the need for fasteners. If the material used to construct the surface of the decorative article is sufficiently rigid, the decorative article will be self-supporting. If the material used to construct the surface of the decorative article is not sufficiently self-supporting, supports may be located between the retainers. The channels may be oriented at an angle, or may be provided with a texture, to assist in retaining the material used to construct the surface of the decorative article.

4 Claims, 7 Drawing Sheets

SYSTEM AND METHOD OF FASTENERLESS CONSTRUCTION OF A DECORATIVE ARTICLE

BACKGROUND AND SUMMARY OF THE INVENTION

The present invention relates generally to a system and method for constructing a decorative article without the need for fasteners. More particularly, the present invention is a system and method for securing a substantially decorative construction material, such as, for example, the weave of a basket or the fabric of a lampshade, without the need for a fastener or fasteners. The present invention employs at least one, and typically a pair of particularly shaped and sized retainers, each having a groove or channel therein for accepting a portion of the construction material.

When constructing decorative articles such as woven baskets, lampshades, or other similar and substantially hollow structures, it is generally required at some point in the construction process to employ fasteners, such as, for example, nails, staples, screws, bolts, or adhesives, in order to secure the material forming the shell (outer surface) of the article. Although such fasteners are adequate to secure the material, they are often unsightly and, therefore, undesirable. This may be especially true if the fasteners must be located on a highly visible portion of the finished article.

The system and method of the present invention allows such decorative articles to be constructed without the need for such fasteners. The system and method of the present invention allows for a finished decorative article that is generally more aesthetically pleasing than a similar article manufactured using the aforementioned fasteners. More particularly, the system and method of the present invention employs at least one and, more commonly, a pair of retainers, each having a groove or channel located around the periphery thereof. When constructing a substantially hollow basket, for example, a retainer pair may be used, consisting of a solid and hollow ring of some thickness sufficient to house the groove or channel. It should be realized, however, that the retainers may be of practically any shape, as necessary to provide the desired outer shape of the article being produced.

In use, the retainers will typically lie in substantially parallel planes that are spaced apart by some predetermined distance. Thus, there is generally a top and bottom, or left and right retainer. The retainer pair may be of the same size, or may be of different size, depending on the desired shape of the article being produced. If the item being produced is manufactured of a substantially rigid material, the material itself may maintain the retainer pair in a spatial relationship. Alternatively, if the item being produced is manufactured or covered by a substantially non-rigid material, supports may be used to maintain the retainer pair in a particular spatial relationship.

During the manufacturing process, a portion of each end of the material forming the outer surface of the article is inserted into and retained by the groove or channel in each of the retainers. For example, when manufacturing a typical woven basket, one end of each of a plurality of vertical weavings is placed into the channel around the periphery of a bottom retainer. Horizontal weaving weavings may then be interlaced with the vertical weavings to form a basket. Once the placement of the horizontal weavings is complete, or nearly complete, the other end of each vertical weaving may be inserted into the channel in the top retainer. The vertical weavings will be held in the channels and, thus, a basket may be constructed without the need for any fasteners. Other materials may be held by the retainers in a similar manner. For example, a lampshade could be assembled by employing thin support rods to maintain a spacing of the retainers. The fabric lampshade covering may thereafter be wrapped around the periphery of the shape created by the retainers, with each end thereof being tucked into the channel in the respective retainer.

The material forming the outer surface of the article being produced may be held in the channel by a number of actions. For example, in the case of basket material, the bending of the vertical weavings will cause the portion thereof inserted into the channel to exert a force against one surface of the channel. This force may be sufficient to retain the weaving ends in the channels. The channel may also be cut at some angle with respect to horizontal to exacerbate the amount of force exerted by the bent material residing therein. Alternatively, the channel may be formed at some particular width, which will retain by friction the material that will be inserted therein. By forming the channel to be only slightly wider than the thickness of the material to be inserted therein, and then forcing the material into the channel, frictional forces will act to resist removal of the material therefrom. It is also contemplated that the channel in each retainer may be provided with a rough texture, or otherwise be treated to enhance its ability to retain the material introduced thereto.

The system and method of the present invention allows for the fastenerless construction of a variety of decorative items, thereby enhancing the aesthetic appearance thereof. The system and method of the present invention can be better understood by reference to the detailed description of certain exemplary embodiments found below.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF THE EXEMPLARY EMBODIMENT(S)

As can be appreciated by one skilled in the art upon reference to the written description and drawings, that the system and method of the present invention can be used to accomplish the fastenerless manufacture of a wide variety of decorative items. However, for purposes of clarity, the system and method of the present invention will be described in detail below only with respect to the manufacture of an exemplary woven basket and fabric lampshade. It is to be understood, however, that these exemplary embodiments are provided for illustration only, and are in no way intended to limit the scope of the present invention thereto.

Figure 1:
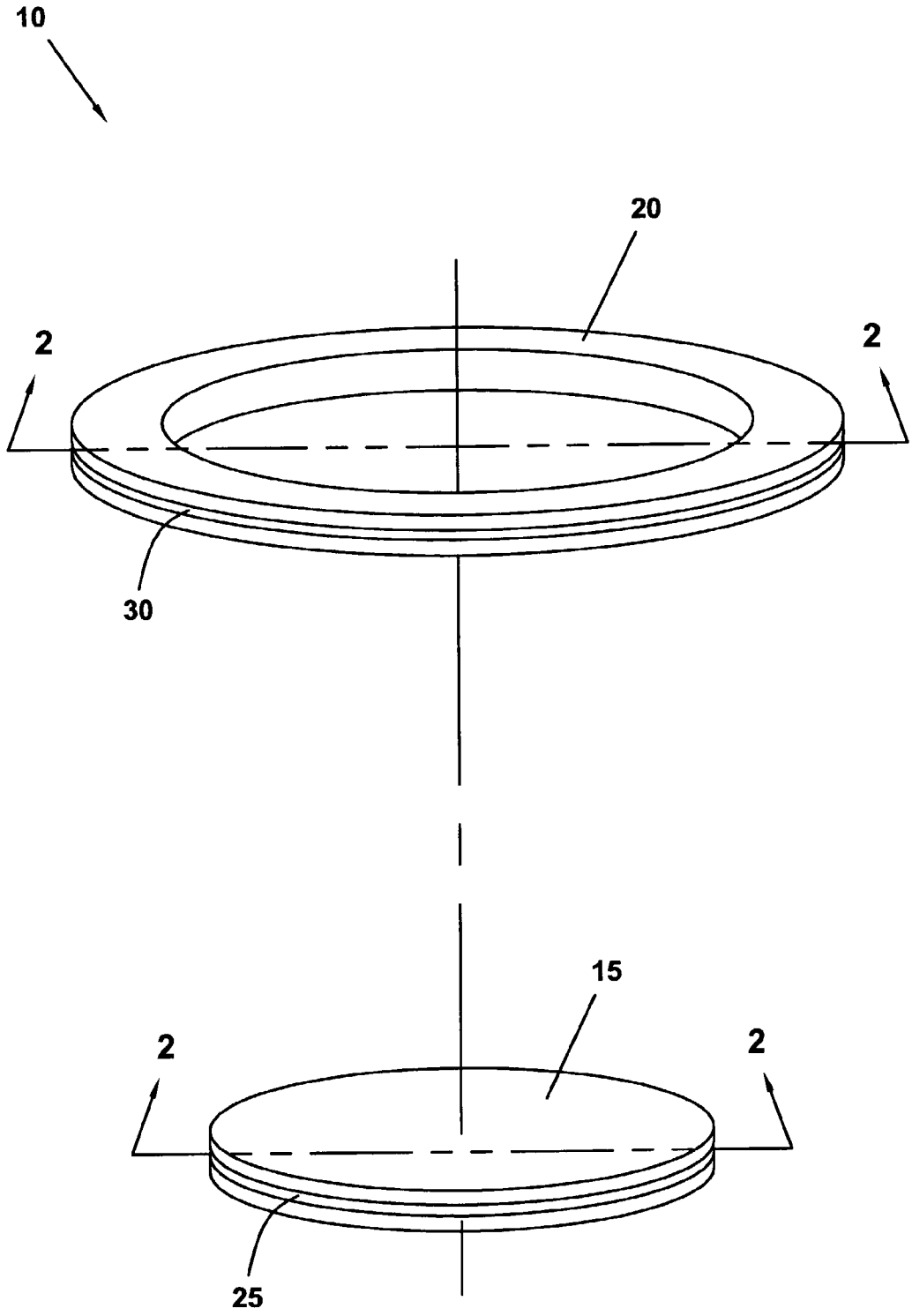
FIG. 1 is a perspective view of one embodiment of a retainer pair of the present invention, shown to have a separated, but substantially parallel spatial relationship.
Figure 2A:
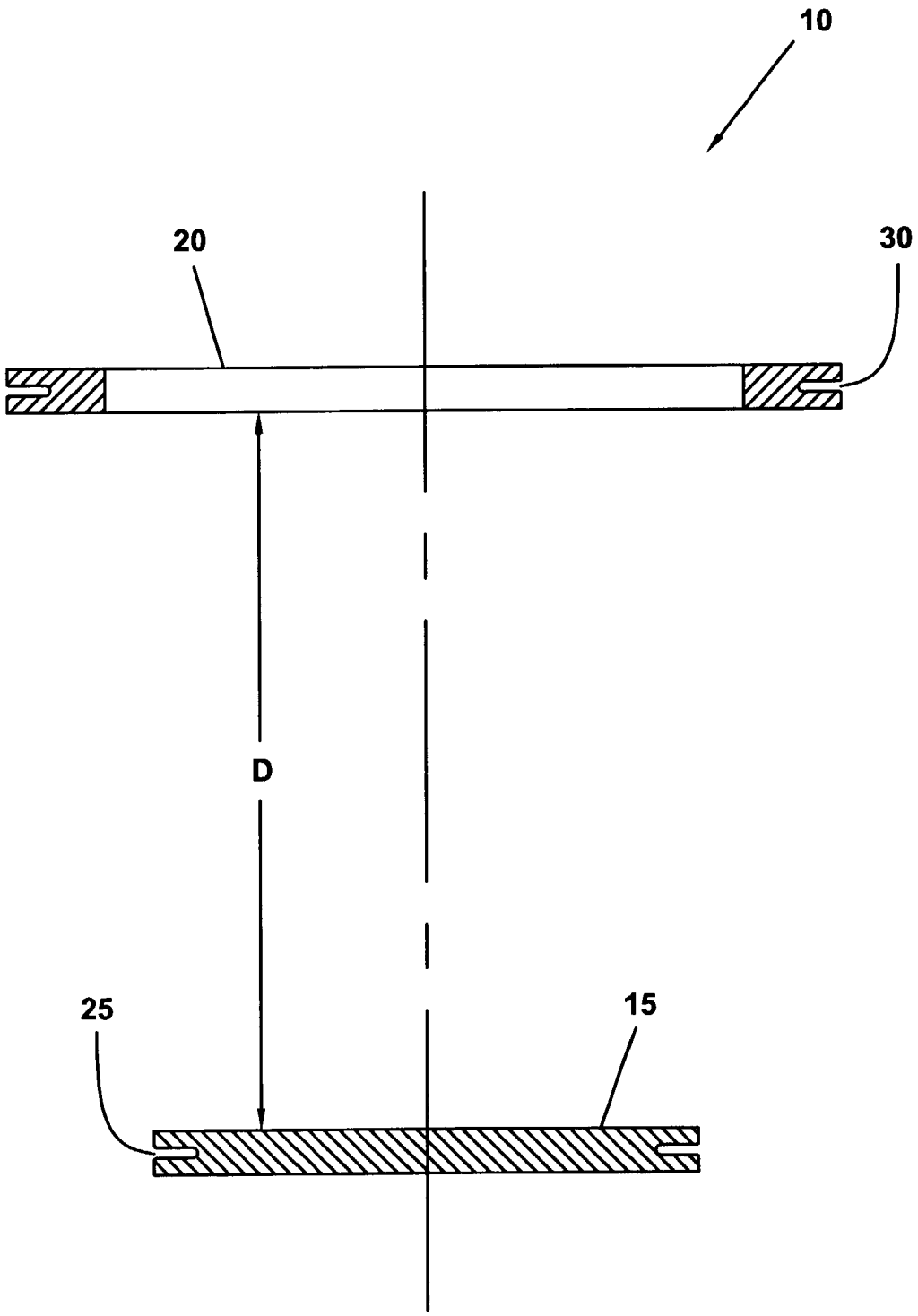
FIG. 2A is a front elevational view, in cross-section, of the retainer pair of FIG. 1.
Figure 2B:
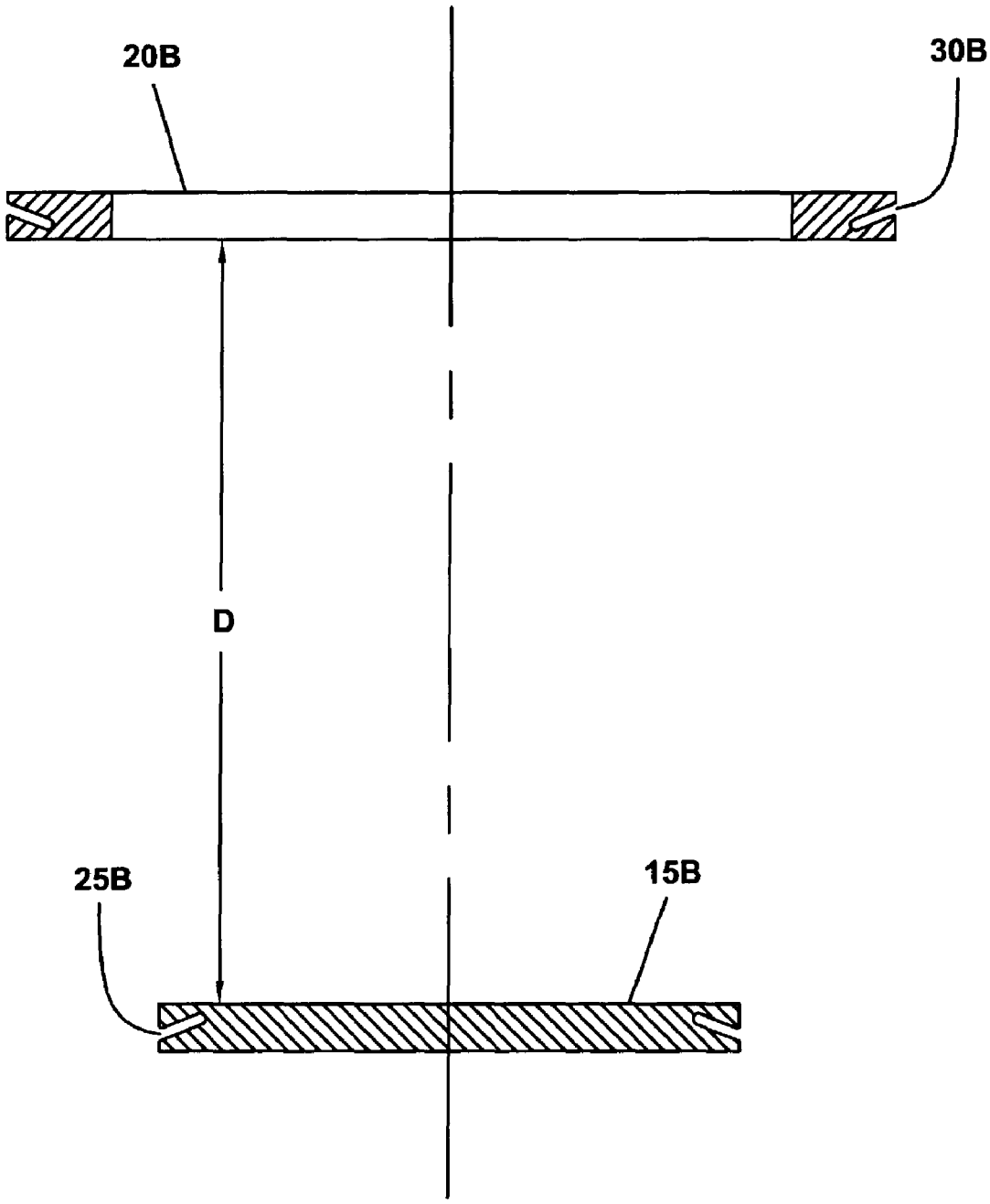
FIG. 2B is a front elevational view, in cross-section, of an alternate embodiment of the top retainer of the retainer pair of FIG. 1.
Figure 3:
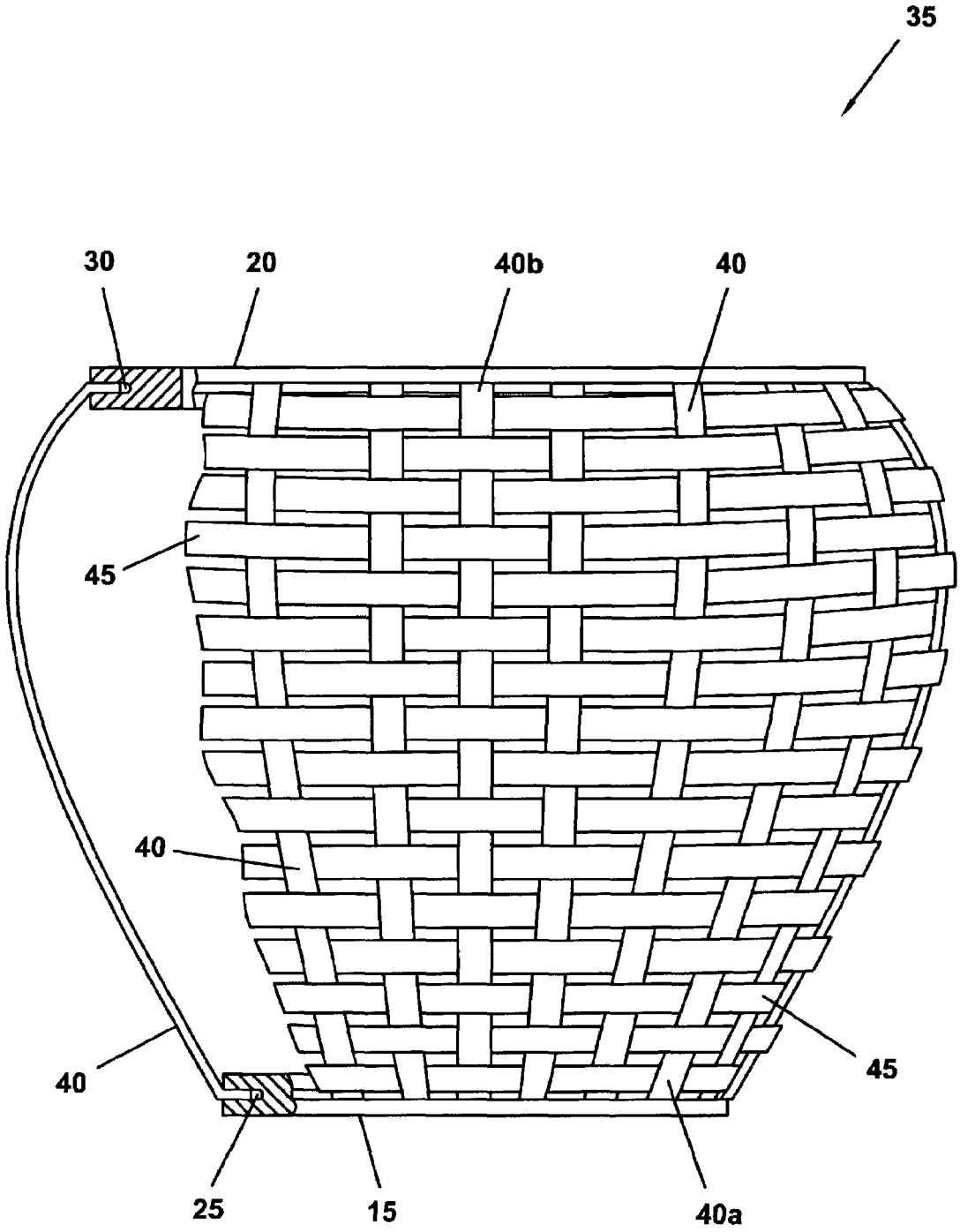
FIG. 3 is a front elevational view showing a woven basket, in partial cross-section, manufactured according to the method of the present invention and using the retainer pair of FIG. 1.

FIGS. 1–3 are directed to one embodiment of the system and method of the present invention, wherein a pair of channel containing retainers are employed to create a woven basket. In typical woven basket manufacture, the structure of the basket is begun at the base. In common basket designs, this typically involves providing a block of wood to which a plurality of vertical weavings may be affixed—although it may also be possible to simply fasten together the bottom ends of each vertical weaving. The vertical weavings are normally affixed to the base block (or to each other) by means of fasteners, such as nails, screws, staples, reeds, or twine. The base block is dimensioned, and the vertical weavings are provided at some predetermined length, to result in a basket of some particular height and circumference, or width (as determined by the horizontal weavings). Once the vertical weavings have been affixed to the base block, the horizontal weavings may be woven therethrough. After the last horizontal weaving has been installed at the top of the basket, a band of weaving material is typically wrapped around the top circumference, and each of the vertical weavings is then fastened thereto. Typically this fastening process also employs nails, screws, or staples, each of which is generally visible on the finished basket.

The system and method of the present invention allows such a basket to be constructed without the use of nails, screws, staples or adhesives. Referring to FIGS. 1–2A, one embodiment of a retainer pair 10 of the present invention that can be used to construct a similar basket may be observed. The retainer pair 10 is shown to consist of a bottom retainer 15 and a top retainer 20. The top retainer 20 is in the form of a hollow ring to allow for access to the inside of the basket once the weaving process is complete. The bottom retainer 15 consists of a substantially solid disc, which will form the bottom portion of the basket upon completion of the weaving process. Each of the bottom and top retainers 15, 20 can be seen to have its own retaining channel 25, 30 for accepting and retaining a portion of the vertical weavings of the basket.

Referring specifically to FIG. 2A, each retaining channel 25, 30 can be seen to extend some distance into its respective retainer 15, 20. The depth, and also the height (width) of the channel will depend on the particular construction material that will be inserted therein, as well as the particular item being constructed. Although the channels 25, 30 are shown to be oriented substantially parallel to the top and bottom surface of each retainer 15, 20, it should be realized that the channels can also be placed therein at an angle. For example, as shown in FIG. 2B, the angle of the channel 30*b* in the top retainer 20*b* can be oriented downward, toward the bottom surface thereof, thereby increasing the bend in the ends of the vertical weavings once they are inserted into the channel. By employing such a channel angle, additional holding power may be generated, as the greater bending of the material placed therein may cause a correspondingly greater upward force of the material against the channel's upper wall. A similar design may be employed for the channel 25*b* of the bottom retainer 15*b*.

As can also be observed in FIGS. 1–3, the retainer pair 10 is designed to have a separated spatial relationship. When used to form a basket, the top retainer 20 is designed to reside some distance D away from the bottom retainer 15. The distance D will depend upon the desired dimensions of the finished basket. The retainer pair 10 is also shown to have a substantially planar spatial relationship in this particular embodiment of the present invention. Preferably, the retainer pair 10 is substantially parallel, so that the top and bottom surface of the finished basket will also be substantially parallel. To impart a uniform shape to the finished basket, the centerlines of each retainer 15, 20 are also preferably aligned, as shown.

A basket 35 constructed using the system and method of the present invention is depicted in FIG. 3. The basket 35 is shown to be of woven construction, and to employ the top retainer 20 and bottom retainer 15 shown in FIGS. 1 and 2A. The basket 35 is constructed by initially inserting a first end 40*a* of each of a plurality of vertical weaving members 40 into the channel 25 of the bottom retainer 15. The vertical weaving members 40 are preferably substantially equidistantly disposed around the perimeter of the bottom retainer 15. Once the first end 40*a* of each of the vertical weaving members 40 has been inserted into the channel 25 in the bottom retainer 15, the horizontal weaving members 45 may be installed to the basket 35. Typically, the horizontal weaving members 45 are woven between the vertical weaving members 40 starting near the bottom of the basket 35, and working upward. During the weaving process, the bottom retainer 15 acts to hold the vertical weaving members 40 in place.

Once all of the horizontal weaving members 45, or a substantial portion thereof, have been woven into position, the second ends 40*b* of the vertical weaving members 40 are inserted into the channel 30 in the top retainer 20. Any uninstalled horizontal weaving members 45 may then be added or, if all the horizontal weaving members have already been installed, the weaving process and, thus, the basket 35 is complete. The shape and weaving of the basket 35 will be maintained due to retainment of the vertical weaving members 40 by the channels 25, 30 in the top and bottom retainers 15, 20. Because the vertical weaving members 40 in this embodiment are semi-rigid, the desired spacing between the top retainer 20 and the bottom retainer 15 will be substantially maintained without additional support. Therefore, a woven basket 35 may be completely constructed without the use of any unsightly fasteners, such as nails, staples or screws.

Figure 4:
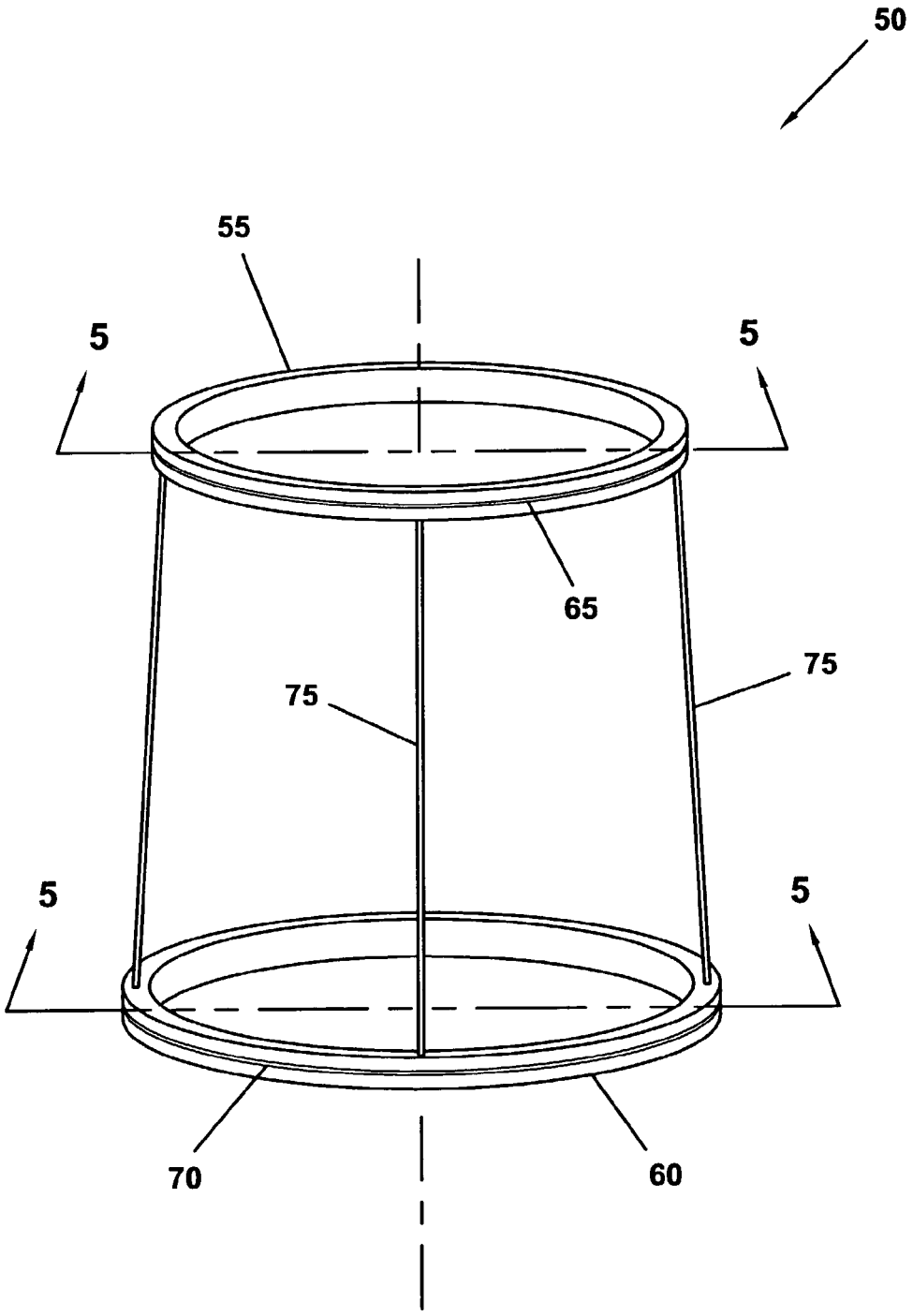
FIG. 4 is a perspective view of an alternate embodiment of a retainer pair of the present invention, shown to have a separated, but substantially parallel spatial relationship maintained by a number of support rods.
Figure 5:
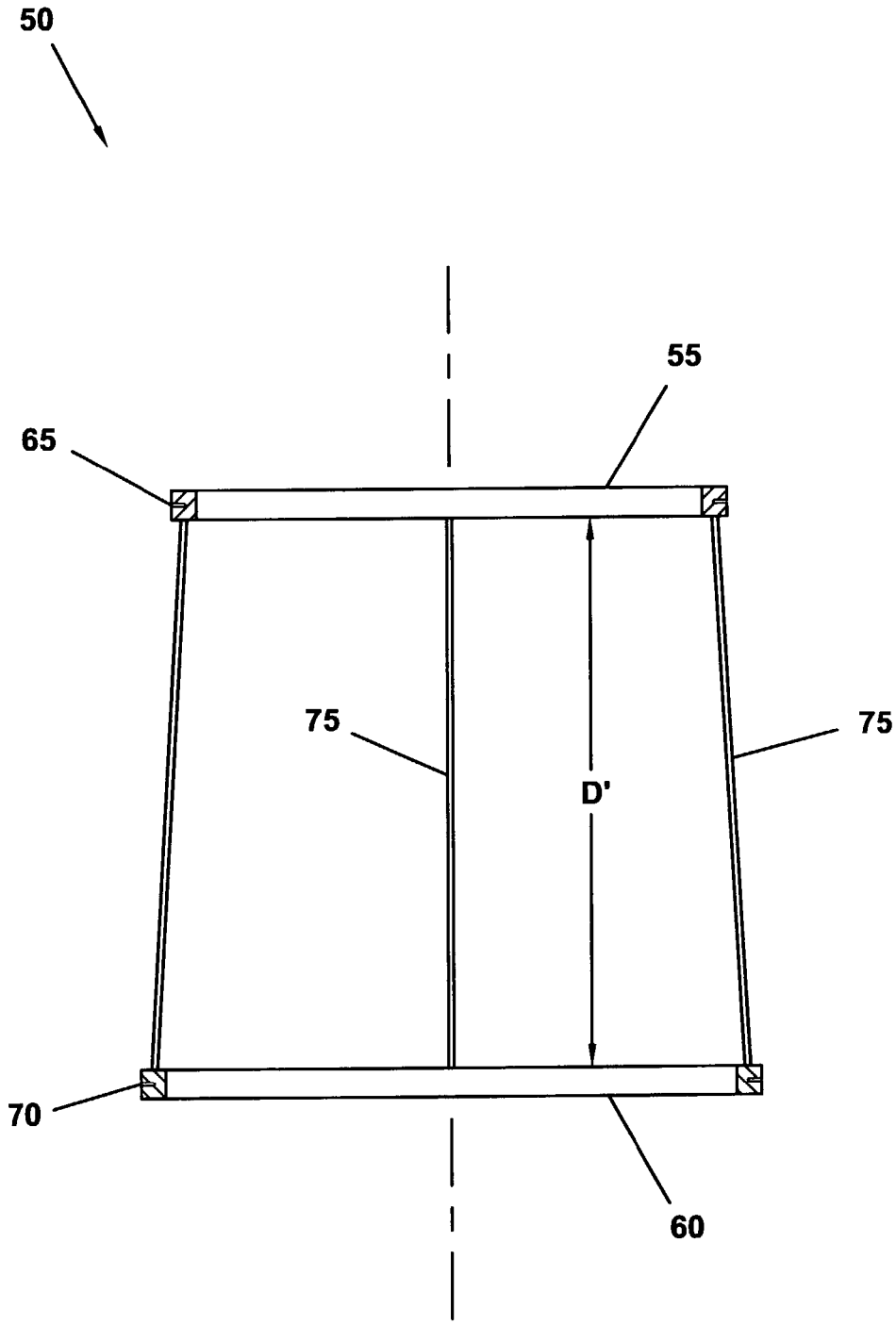
FIG. 5 a front elevational view, in cross-section, of the retainer pair and support rods of FIG. 4.
Figure 6:
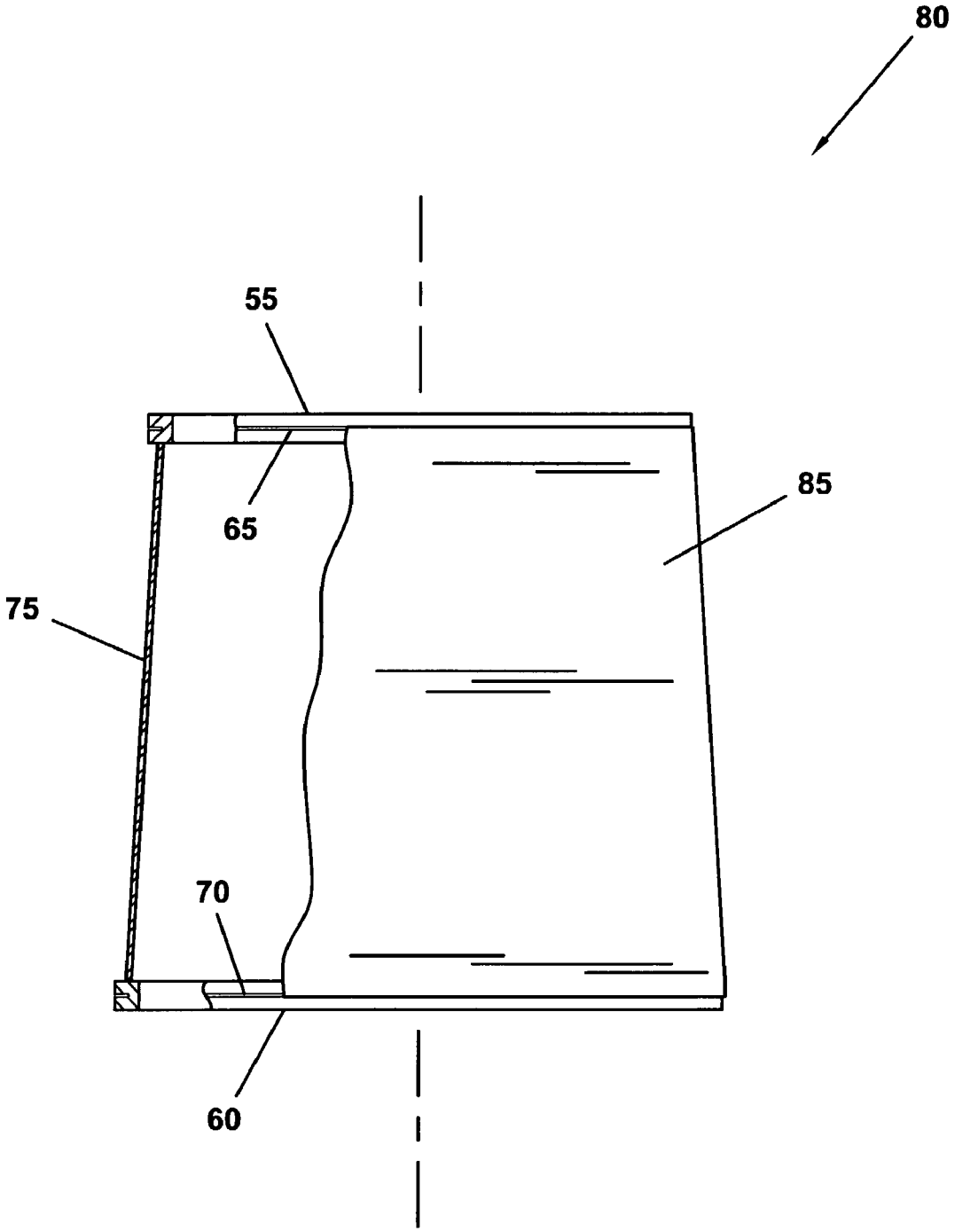
FIG. 6 is a front elevational view showing a lampshade, in partial cross-section, manufactured according to the method of the present invention and using the retainer pair of FIG. 4.

FIGS. 4–6 are directed to an alternate embodiment of the system and method of the present invention, wherein a pair of channel containing retainers are employed to create a lampshade. In typical lampshade manufacture, an upper and lower wire ring are connected by a number of substantially upright connecting wires. The wire rings and connecting wires may be of different sizes and lengths, depending on the desired shape of the finished lampshade. The wire material is typically sufficiently rigid so that a self-supporting wireframe is created by the connection of the wire rings and connecting wires. A covering material, such as a fabric, is then typically wrapped around the wire frame to form the outer surface of the lampshade. Generally, the covering material is affixed at each end to the corresponding upper and lower wire ring. Typically, affixation is accomplished by folding the covering material over the wire rings and then sewing or bonding the material to itself.

While the above described method is sufficient to construct a lampshade, it does not allow the covering material of the lampshade to be removed for cleaning, nor for the covering material to be easily replaced with new material, such as may be desired when redecorating. By employing the retainers of the present invention, an aesthetically pleasing lampshade may be created without the need for permanent fastening, or the use of fasteners. The retainers of the present invention also permit the covering material of the lampshade to be removed without damage thereto, whereafter the material may be reattached, or may be replaced with a different covering material.

A retainer pair 50 for use in constructing a lampshade is best observed by reference to FIGS. 4 and 5. As can be seen, the retainer pair consists of a top retainer 55 and a bottom retainer 60. Both the top retainer 55 and bottom retainer 60 are in the form of a hollow ring to allow the lampshade to be placed onto the light fixture and to allow light therefrom to shine upward from the lampshade once installed. Each of the top and bottom retainers 55, 60 can be seen to have its own retaining channel 65, 70 for accepting and retaining a portion of the covering material of the lampshade.

Referring specifically to FIG. 5, each retaining channel 65, 70 can be seen to extend some distance into its respective retainer 55, 60. The depth, and also the height (width) of the channel will depend on the particular covering material that will be inserted therein. Although the channels 65, 70 are shown to be oriented substantially parallel to the top and bottom surface of each retainer 55, 60, it should be realized that, similar to the embodiment of the retainer of the present invention shown in FIG. 2B, the channels can also be placed therein at an angle. Preferably, when a material such as a typical lampshade covering material is to be held by the retainers 55, 60, the channels 65, 70 are sized to result in a friction fit with the material inserted thereto. It may also be possible to impart a texture to, or otherwise treat the interior of the channels 65, 70 to enhance their ability to retain the material inserted therein.

As can also be observed in FIGS. 4–6, the retainer pair 50 is designed to have the separated spatial relationship required to form a lampshade. The top retainer 55 is designed to reside some distance D' away from the bottom retainer 60. The distance D' will depend upon the desired dimensions of the finished lampshade. Because the material typically used to cover a lampshade is not sufficiently rigid to maintain the spatial relationship of the retainer pair 50, support rods 75 are inserted therebetween. In this particular embodiment, four support rods 75 are employed, however, the number of support rods may vary depending on the design of the lampshade. The support rods 75 may be located inward of the outside edge of the retainers 55, 60 (as shown) or, may be located to be aligned with the outside edge of the retainers to provide additional support to the covering material to be applied. Alternatively, if a sufficiently rigid covering material is used, the support rods 75 may be rendered unnecessary. The retainer pair 50 is also shown to be substantially planar. In this particular embodiment, the retainer pair 50 is substantially parallel, so that the top and bottom surface of the finished lampshade will also be substantially parallel. However, the retainer pair 50 may have a different orientation, depending on the desired shape of the lampshade. To impart a uniform shape to the lampshade, the centerlines of each retainer 55, 60 are also preferably aligned, as shown.

A lampshade 80 constructed using the system and method of the present invention is depicted in FIG. 6. The lampshade 80 is shown to consist of the top retainer 55 and bottom retainer 60, connected by a number of the support rods 75, as shown in FIGS. 4 and 5. The lampshade 80 is finished by wrapping an appropriately cut piece of covering material 85 around the circumference of the retainer pair 50, and inserting the top edge and bottom edge thereof into the channels 65, 70 in the top and bottom retainers 55, 60, respectively. The covering material 85 may be sized to provide an overlapping vertical seam (not shown) upon installation. In this embodiment, friction between the covering material 85 and the inside surface of each channel 65, 70 acts to hold the covering material firmly in place after insertion. Consequently, a lampshade may be constructed that is aesthetically pleasing, that requires no permanent fasteners, and wherein the covering material 85 thereof may be removed or replaced without damage to either the covering material or to the retainers 55, 60.

Both the woven basket embodiment and the lampshade embodiment of the present invention described in detail above employ a retainer pair having a circular profile. However, it should be realized that the retainer pair may be of a multitude of other shapes, such as, for example, square, rectangular, triangular, or a plurality of other polygonal shapes. The shape of the retainer pair will depend on the desired shape of the article being constructed therewith. Additionally, the spatial relationship may be different than that illustrated in the above exemplary embodiments. For example, the spacing between the retainer pair may vary, and/or the retainer pair may be oriented in a non-parallel manner.

Other embodiments of the present invention are also contemplated to be within the scope of the present invention, although not specifically described herein. For example, more than two retainers may be used, wherein there is a top retainer and a bottom retainer, with an intermediate retainer disposed therebetween. In such an embodiment, the intermediate retainer may be provided with two channels, each to receive one end from one of two different groups or pieces of covering material. Alternatively, the intermediate retainer may employ a single groove, sized to receive one end from both groups or pieces of covering material. As discussed above, it is also contemplated that the interior of the channels located in the retainers of the present invention may be provided with a rough texture, or be otherwise treated to maximize their holding power on the material that will be introduced thereto.

As can be deduced from an examination of the above exemplary embodiments of the present invention, the channel containing retainers may be employed to provide for fastenerless construction of a variety of decorative articles. Thus, while the previous exemplary embodiments detail the construction of a woven basket and a lampshade, it is to be understood that the scope of the present invention is not limited thereto. As such, while certain embodiments of the present invention are described in detail above, the scope of the invention is not to be considered limited by such disclosure, and modifications are possible without departing from the spirit of the invention as evidenced by the following claims:

What is claimed is:

1. A basket, comprising:

a top retainer and a bottom retainer, each retainer having an upper surface, a lower surface and a channel;

a top retainer channel formed on a perimeter of the top retainer, the top retainer channel angled toward the lower surface;

the bottom retainer channel formed on a perimeter of the bottom retainer, the bottom retainer channel angled toward the upper surface; and a plurality of first pliant elongate weaving elements of predetermined length, each of the first weaving elements having a bottom end frictionally retained in the bottom retainer channel and a top end frictionally retained in the top retainer channel, the first weaving elements arranged substantially equidistantly around a perimeter of the respective retainers; and a plurality of second elongate weaving elements interlaced in the first weaving elements along the lengths thereof.

2. The basket of claim 1, wherein the first weaving elements are strips of wood.

3. The basket of claim 1, wherein the bottom end of each first weaving element is angled upward, after insertion.

4. The basket of claim 1, wherein the top end of each first weaving element is angled downward, after insertion.

* * * * *